US011580841B2

(12) United States Patent
Lin et al.

(10) Patent No.: US 11,580,841 B2
(45) Date of Patent: Feb. 14, 2023

(54) DEVICE AND METHOD FOR ALARM DETECTION

(71) Applicant: LITE-ON TECHNOLOGY CORPORATION, Taipei (TW)

(72) Inventors: Su-Chen Lin, Taipei (TW); Chun-Yen Chen, Taipei (TW)

(73) Assignee: LITE-ON TECHNOLOGY CORPORATION

( * ) Notice: Subject to any disclaimer, the term of this patent is extended or adjusted under 35 U.S.C. 154(b) by 0 days.

(21) Appl. No.: 17/469,672

(22) Filed: Sep. 8, 2021

(65) Prior Publication Data

US 2022/0207984 A1 Jun. 30, 2022

(30) Foreign Application Priority Data

Dec. 24, 2020 (TW) ..... 109145971

(51) Int. Cl.
*G08B 21/18* (2006.01)
*G10L 25/51* (2013.01)

(52) U.S. Cl.
CPC ..... *G08B 21/182* (2013.01); *G10L 25/51* (2013.01)

(58) Field of Classification Search
CPC ..... G08B 21/182; G10L 25/51
USPC ..... 340/550
See application file for complete search history.

(56) References Cited

U.S. PATENT DOCUMENTS 4,450,436 A * 5/1984 Massa ..... G08B 1/08 367/117
4,617,555 A * 10/1986 Sheiman ..... G08B 1/08 367/199
5,420,581 A * 5/1995 Peters ..... G08B 21/182 73/645
5,471,195 A * 11/1995 Rickman ..... G08B 13/1672 340/556
5,510,767 A * 4/1996 Smith ..... G08B 13/1672 340/550
7,388,487 B2 * 6/2008 Smith ..... G08B 13/04 340/544
9,830,807 B2 * 11/2017 Bass ..... G10L 25/51
10,964,193 B2 * 3/2021 Mandl ..... G08B 7/06
2005/0264411 A1 * 12/2005 Katz ..... G08B 25/008 340/506
2006/0012478 A1 * 1/2006 Carmichel ..... G08B 3/10 340/552

(Continued)

FOREIGN PATENT DOCUMENTS

CN 202217357 U 5/2012
TW 202044207 A 12/2020

OTHER PUBLICATIONS

Communication corresponding to Taiwan Application No. 109145971 and issued by Taiwan Intellectual Property Office dated Oct. 4, 2021, 5 pages.

*Primary Examiner* — Zhen Y Wu
(74) *Attorney, Agent, or Firm* — Innovation Counsel LLP

(57) ABSTRACT

An alarm detection device includes: a sound receiver for receiving an external sound to output a first signal; a signal processing circuit coupled to the sound receiver, for receiving the first signal to output a second signal; and an alarm decision circuit coupled to the signal processing circuit, during a time range, when a number of the second signals meeting a trigger criteria is equal to a predetermined value, the alarm decision circuit outputting an alarm signal.

11 Claims, 4 Drawing Sheets

(56) References Cited

U.S. PATENT DOCUMENTS

| | | | | |
|---|---|---|---|---|
| 2013/0308783 | A1* | 11/2013 | Gao | G08B 21/182 381/56 |
| 2016/0379671 | A1* | 12/2016 | Lacson | G10L 25/48 704/254 |
| 2017/0011619 | A1* | 1/2017 | Bass | G10L 25/51 |
| 2017/0309161 | A1* | 10/2017 | Gallagher | G08B 13/1672 |
| 2018/0089985 | A1* | 3/2018 | Seelman | G08B 1/08 |
| 2019/0362614 | A1* | 11/2019 | Mandi | G10L 25/51 |
| 2020/0202884 | A1* | 6/2020 | Phan Le | H04R 3/12 |
| 2021/0020018 | A1* | 1/2021 | Kim | G08B 21/182 |

* cited by examiner

DEVICE AND METHOD FOR ALARM DETECTION

This application claims the benefit of Taiwan application Serial No. 109145971, filed Dec. 24, 2020, the subject matter of which is incorporated herein by reference.

BACKGROUND OF THE INVENTION

Field of the Invention

The invention relates in general to a device and a method for alarm detection.

Description of the Related Art

Fire disasters have always been an issue of great concern to people. Safety detectors, such as smoke alarms, are capable of enhancing the safety of people' life and property and have gradually attracted people' attention.

In recent years, the popularity of mobile devices, such as smart watches, smartphones and PC tablets, boosts the application of mobile devices and the Internet. Mobile devices, network communication and the Internet in combination with safety detectors at home can be integrated as an application platform of a smart-home safety system. Through the use of mobile devices, the users can immediately obtain whether the safety system or alarm system at home has detected any abnormities.

Sometimes, people' auditory sense may not be able to correctly detect the alarm sound emitted by a smoke alarm. If the device and method for alarm detection, after successfully detecting continuous alarm sound emitted by a smoke alarm, can send a notice to remind the user or relevant organizations (such as a fire brigade or an ambulance) to take proper actions, the safety of people' life and property will be further enhanced.

SUMMARY OF THE INVENTION

According to one embodiment of the present invention, an alarm detection device including a sound receiver, a signal processing circuit and an alarm decision circuit is provided. The sound receiver is for receiving an external sound to output a first signal. The signal processing circuit is coupled to the sound receiver for receiving the first signal to output a second signal. The alarm decision circuit is coupled to the signal processing circuit for outputting an alarm signal when a number of the second signals meeting a trigger criterion is equal to a predetermined value during a time rang.

According to another embodiment of the present invention, an alarm detection method is provided. The method includes receiving an external sound to output a first signal; receiving the first signal to output a second signal; and outputting an alarm signal when a number of the second signals meeting a trigger criterion is equal to a predetermined value during a time range.

The above and other aspects of the invention will become better understood with regard to the following detailed description of the preferred but non-limiting embodiment(s). The following description is made with reference to the accompanying drawings.

DETAILED DESCRIPTION OF THE INVENTION

Technical terms are used in the specification with reference to generally known terminologies used in the technology field. For any terms described or defined in the specification, the descriptions and definitions in the specification shall prevail. Each embodiment of the present disclosure has one or more technical features. Given that each embodiment is implementable, a person ordinarily skilled in the art can selectively implement or combine some or all of the technical features of any embodiment of the present disclosure.

Figure 1:
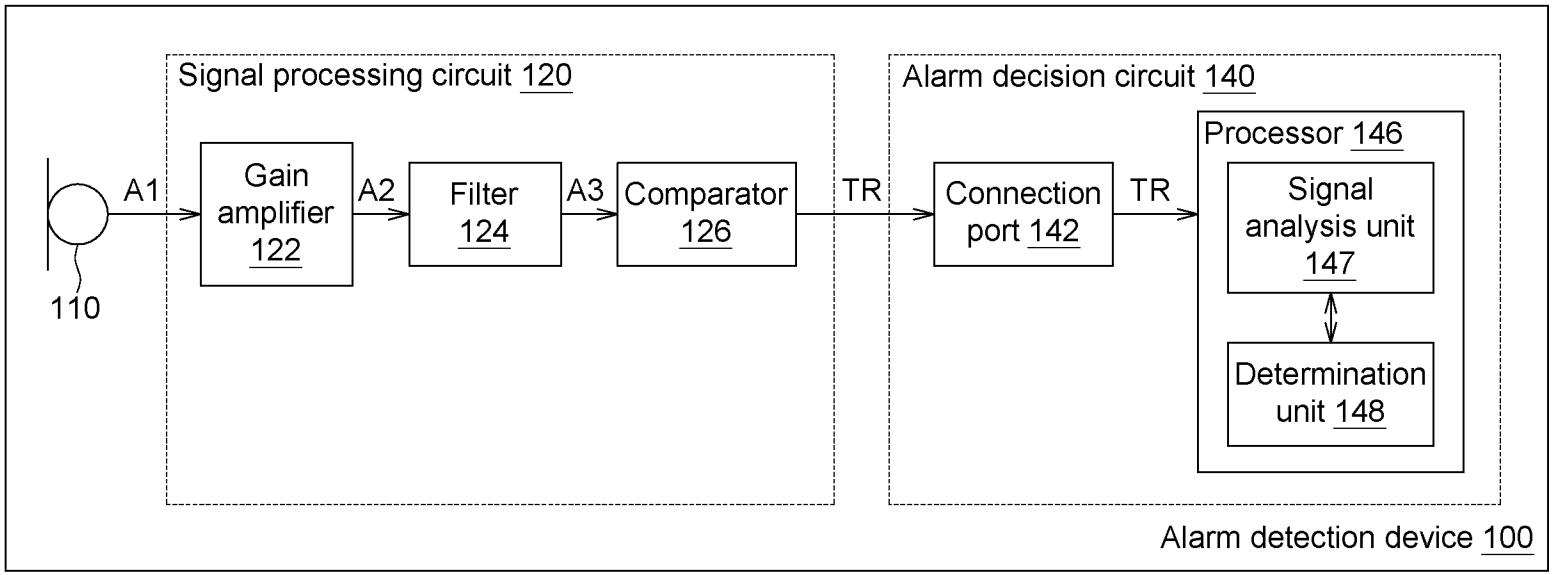
FIG. 1 is a functional block diagram of an alarm detection device according to an embodiment of the present disclosure.

Referring to FIG. 1, a functional block diagram of an alarm detection device according to an embodiment of the present disclosure is shown. As indicated in FIG. 1, the alarm detection device 100 includes: a sound receiver 110 for receiving an external sound to output a first signal A1; a signal processing circuit 120 coupled to the sound receiver 110 for receiving the first signal to output a second signal TR; and an alarm decision circuit 140 coupled to the signal processing circuit 120 for outputting an alarm signal when the number of the second signal TR meeting a trigger criterion is equal to a predetermined value during a time range.

In an embodiment of the present disclosure, the trigger criterion is whether the logic-high time of the second signal TR is greater than a standard value.

In an embodiment of the present disclosure, the trigger criterion further includes whether a time interval between two adjacent second signals TR both having logic-high time greater than the standard value is less than a cycle threshold.

In an embodiment of the present disclosure, when the time interval between two adjacent second signals TR both having logic-high time greater than the standard value is less than the cycle threshold, the alarm decision circuit 140 adds the number of the second signals TR meeting the trigger criterion by 1.

In an embodiment of the present disclosure, when the time interval between two adjacent second signals TR both having logic-high time greater than the standard value is not less than the cycle threshold, the alarm decision circuit 140 sets the number of the second signals TR meeting the trigger criterion to 0.

Examples of the sound receiver 110 include but not limited to a microphone. The sound receiver 110 is for receiving an external sound, such as the ambient noises or the alarm sound emitted by a smoke alarm. The frequency of the sound that the sound receiver 110 can receive can be exemplified by 50 Hz-10 KHz but is not limited thereto. The sound received by the sound receiver 110 is transmitted to the signal processing circuit 120. The sound receiver 110 is for receiving an external sound, such as an alarm sound emitted by an alarm (such as a smoke alarm) to generate a first signal A1.

The signal processing circuit 120 includes a gain amplifier 122, a filter 124 and a comparator 126.

The gain amplifier 122 is coupled to the sound receiver 110 for amplifying the first signal A1 generated by the sound receiver 110 to become a third signal A2.

The filter 124 is coupled to the gain amplifier 122 for filtering the third signal A2 generated by the gain amplifier 122 to become a fourth signal A3. The filter 124 can be, for example but not limited by, a band-pass filter. When the sound emitted by an alarm (such as a smoke alarm) has a frequency of 3 KHz, the filter 124 is a 3 KHz band-pass filter which filters off the signal whose frequency is not 3 KHz.

The comparator 126 is coupled to the filter 124 for comparing the fourth signal A3 generated by the filter 124 with a sound volume threshold LT. When the fourth signal A3 generated by the filter 124 is greater than the sound volume threshold LT, the comparator 126 outputs the second signal TR to the alarm decision circuit 140 for triggering the alarm decision circuit 140 to determine whether the sound of an alarm (such as a smoke alarm) is correctly received by the alarm decision circuit 140.

The alarm decision circuit 140 includes a connection port 142 and a processor 146. The connection port 142 is coupled to the signal processing circuit 120. The processor 146 is coupled to the connection port 142 for receiving the second signal TR. The processor 146 determines and calculates the number of the second signals TR meeting the trigger criterion.

Examples of the connection port 142 include but not limited to a general-purpose input output (GPIO) pin.

Examples of the processor 146 include but not limited to a central processing unit (CPU). The processor 146 includes a signal analysis unit 147 and a determination unit 148.

The connection port 142 is coupled to the comparator 126 for inputting the second signal TR from the comparator 126 to the processor 146.

The signal analysis unit 147 analyzes the second signal TR.

Based on the analysis by the signal analysis unit 147, the determination unit 148 determines whether the sound of an alarm (such as a smoke alarm) is correctly received. Details are disclosed below.

The processor 146, the signal analysis unit 147 and the determination unit 148 can be implemented by a chip, a circuit block of a chip, a firmware circuit, a circuit board including several electronic elements and wires, or a storage medium storing several programming codes and can also be implemented by a computer system or an electronic device (such as a server) performing corresponding software or programs. The said arrangements are still within the spirit of the present disclosure.

Figure 2:
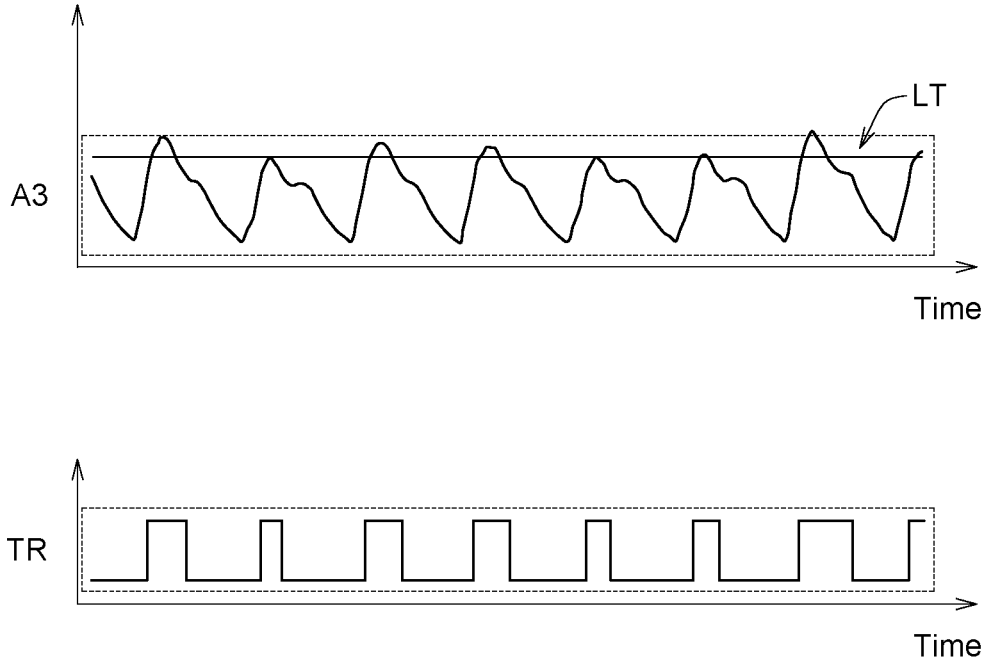
FIG. 2 is a waveform graph of a sound signal generated by a filter and a signal generated by a comparator according to an embodiment of the present disclosure.

FIG. 2 is a waveform graph of the fourth sound signal A3 generated by the filter 124 and the second signal TR generated by the comparator 126 according to an embodiment of the present disclosure. As indicated in FIG. 2, when the fourth signal A3 generated by the filter 124 is greater than the sound volume threshold LT, the comparator 126 outputs the second signal TR.

Details of the alarm decision circuit 140 determining whether the sound of an alarm (such as a smoke alarm) is correctly received are disclosed below. In an embodiment of the present disclosure, when the alarm decision circuit 140 receives the second signal TR, the alarm decision circuit 140 records the timing of the rising edge of each logic-high time of the second signal TR.

In an embodiment of the present disclosure, when the logic-high time Tloud of the second signal TR is greater than or equal to the standard value, the trigger criterion is met, and vice versa.

As disclosed above, the trigger criterion further includes whether the time interval between two adjacent second signals TR both having logic-high time greater than the standard value is less than the cycle threshold.

Conversely, when the time interval between two adjacent second signals TR both having logic-high time greater than the standard value is larger than the cycle threshold, the trigger criterion is not met.

In an embodiment of the present disclosure, when the trigger criterion is met, this implies that the alarm detection device 100 has correctly received the sound of an alarm (such as a smoke alarm) and outputs an alarm signal to the user or relevant organizations (such as a fire brigade or an ambulance).

Figure 3:
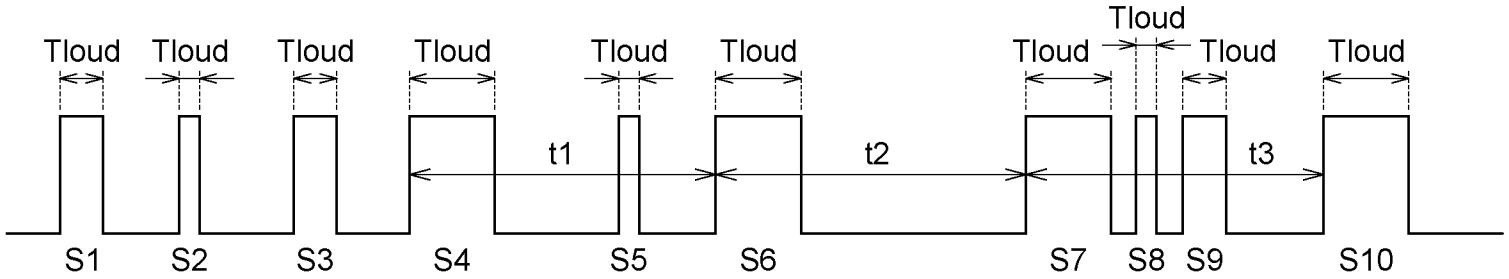
FIG. 3 is a signal waveform graph according to an embodiment of the present disclosure.

FIG. 3 is a signal waveform graph according to an embodiment of the present disclosure. As indicated in FIG. 3, since the logic-high time Tloud of each of the second signals S1~S3 is less than the standard value, the trigger criterion is not met. The second signals S1~S3 could be caused by ambient noises.

The logic-high time Tloud of the second signal S4 is greater than or equal to the standard value.

The logic-high time Tloud of the second signal S5 is less than the standard value.

The logic-high time Tloud of the second signal S6 is greater than or equal to the standard value. Whether the time interval t1 between two adjacent second signals (S4 and S6) both having logic-high time greater than the standard value is less than the cycle threshold Tcycle is determined. As indicated in FIG. 3, the time interval t1 is less than the cycle threshold Tcycle. When the time interval between two adjacent second signals both having logic-high time greater than the standard value is less than the cycle threshold, the alarm decision circuit 140 adds the number of the second signals meeting the trigger criterion by 1 (currently there are 2 second signals meeting the trigger criterion, namely S4 and S6).

The logic-high time Tloud of the second signal S7 is greater than or equal to the standard value. Whether the time interval t2 between two adjacent second signals (S6 and S7) both having logic-high time greater than the standard value is less than the cycle threshold is determined. As indicated in FIG. 3, the time interval t2 is less than the cycle threshold Tcycle. When the time interval between two adjacent second signals both having logic-high time greater than the standard value is less than the cycle threshold, the alarm decision circuit 140 adds the number of the second signals meeting the trigger criterion by 1 (currently there are 3 second signals meeting the trigger criterion, namely S4, S6 and S7).

The logic-high time Tloud of each of the second signals S8 and S9 is less than the standard value.

The logic-high time Tloud of the second signal S10 is greater than or equal to the standard value. Whether the time interval t3 between two adjacent second signals (S7 and S10) both having logic-high time greater than the standard value is less than the cycle threshold is determined. As indicated in FIG. 3, the time interval t3 is less than the cycle threshold Tcycle. When the time interval between two adjacent second signals both having logic-high time greater than the standard value is less than the cycle threshold, the alarm decision circuit 140 adds the number of the second signals meeting the trigger criterion by 1 (currently there are 4 second signals meeting the trigger criterion, namely S4, S6, S7 and S10).

In an embodiment of the present disclosure, the predetermined value can be exemplified by 4 but the present disclosure is not limited thereto. Thus, when the second signal S10 is detected, the determination unit 148 determines that the sound of an alarm (such as a smoke alarm) is correctly received. In an embodiment of the present disclosure, when the number of the second signals (S4, S6, S7 and S10) meeting the trigger criterion is equal to the predetermined value (the predetermined value is 4) during a time range, the alarm decision circuit 140 outputs an alarm signal. In response to the said condition, the alarm detection device 100 outputs an alarm signal to the user or relevant organizations (such as a fire brigade or an ambulance) through wired or wireless communication.

When the time interval between two adjacent second signals both having logic-high time greater than the standard value is not less than the cycle threshold, the alarm decision circuit 140 sets the number of the second signals meeting the trigger criterion to 0.

Figure 4:
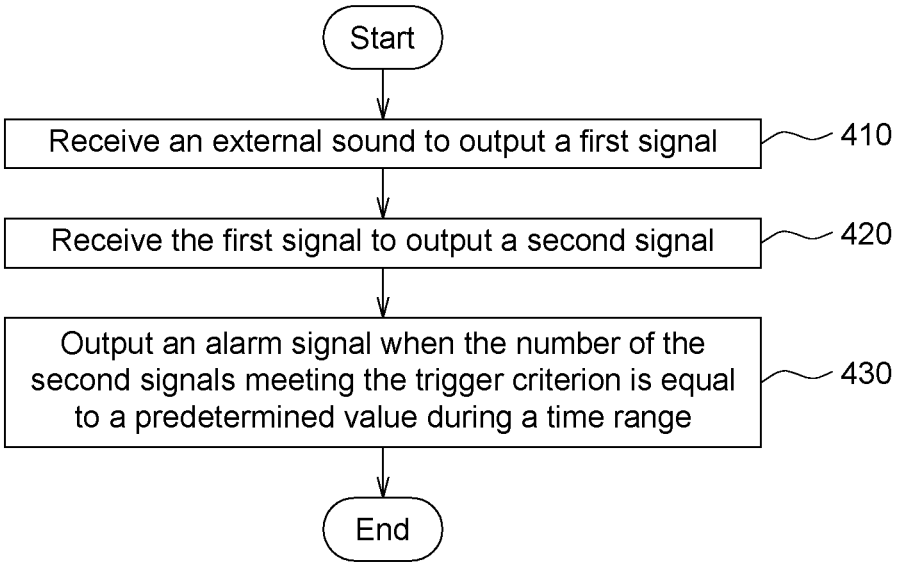
FIG. 4 is a flowchart of an alarm detection method according to an embodiment of the present disclosure.

FIG. 4 is a flowchart of an alarm detection method according to an embodiment of the present disclosure. In step 410, an external sound is received for outputting a first signal. In step 420, the first signal is received for outputting a second signal. In step 430, an alarm signal is outputted when the number of the second signals meeting the trigger criterion is equal to a predetermined value during a time range.

Details of steps 410~430 can be obtained with reference to the above embodiment and the similarities are not repeated here.

If the device and method for alarm detection, after successfully detecting continuous alarm sound emitted by a smoke alarm, can send a notice to remind the user or relevant organizations (such as a fire brigade or an ambulance) to take proper actions, the safety of people' life and property will be further enhanced.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An alarm detection device, comprising:

a sound receiver for receiving an external sound to output a first signal;

a signal processing circuit coupled to the sound receiver for receiving the first signal to output a second signal; and an alarm decision circuit coupled to the signal processing circuit for outputting an alarm signal when a number of the second signals meeting a trigger criterion is equal to a predetermined value during a time range, wherein the trigger criterion is whether a logic-high time of the second signal is greater than a standard value; and the trigger criterion further comprises whether a time interval between two adjacent second signals both having logic-high time greater than the standard value is less than a cycle threshold.

2. The alarm detection device according to claim 1, wherein when the time interval between the two adjacent second signals both having logic-high time greater than the standard value is less than the cycle threshold, the alarm decision circuit adds the number of the second signals meeting the trigger criterion by 1.

3. The alarm detection device according to claim 2, wherein when the time interval between the two adjacent second signals both having logic-high time greater than the standard value is not less than the cycle threshold, the alarm decision circuit sets the number of the second signals meeting the trigger criterion to 0.

4. The alarm detection device according to claim 1, wherein, the signal processing circuit comprises:

a gain amplifier coupled to the sound receiver for amplifying the first signal to become a third signal;

a filter coupled to the gain amplifier for filtering the third signal to become a fourth signal; and a comparator coupled to the filter for comparing the fourth signal with a sound volume threshold to output the second signal when the fourth signal is greater than the sound volume threshold.

5. The alarm detection device according to claim 4, wherein, the filter is a band-pass filter.

6. The alarm detection device according to claim 1, wherein, the alarm decision circuit comprises:

a connection port coupled to the signal processing circuit; and a processor coupled to the connection port for receiving the second signal, wherein, the processor determines and calculates the number of the second signals meeting the trigger criterion.

7. An alarm detection method, comprising:

receiving an external sound to output a first signal;

receiving the first signal to output a second signal; and outputting an alarm signal when a number of the second signals meeting a trigger criterion is equal to a predetermined value during a time rang, wherein the trigger criterion is whether a logic-high time of the second signal is greater than a standard value; and the trigger criterion further comprises whether a time interval between two adjacent second signals both having logic-high time greater than the standard value is less than a cycle threshold.

8. The alarm detection method according to claim 7, wherein when the time interval between the two adjacent second signals both having logic-high time greater than the standard value is less than the cycle threshold, the number of the second signals meeting the trigger criterion is added by 1.

9. The alarm detection method according to claim 8, wherein, when the time interval between the two adjacent second signals both having logic-high time greater than the standard value is not less than the cycle threshold, the number of the second signals meeting the trigger criterion is set to 0.

10. The alarm detection method according to claim 7, wherein, further comprises:

amplifying the first signal to become a third signal;

filtering the third signal to become a fourth signal; and comparing the fourth signal with a sound volume threshold to output the second signal when the fourth signal is greater than the sound volume threshold.

11. The alarm detection method according to claim 10, wherein, a band-pass filter filters the third signal to become the fourth signal.

* * * * *